US005759987A

United States Patent [19]

Haerer et al.

[11] Patent Number: 5,759,987

[45] Date of Patent: Jun. 2, 1998

[54] MIXTURES OF NONIONIC ETHERS FOR USE AS RINSE AIDS AND/OR CLEANING HARD SURFACES

[76] Inventors: Juergen Haerer, Johann-Hesse-Str. 3, 40597 Duesseldorf; Peter Jeschke, Macherscheider Str. 137, 41468 Neuss; Karl Schmid, Stifterstr. 10, 40822 Mettmann; Karin Koren, Heppenheimer Weg 18, 40227 Duesseldorf, all of Germany

[21] Appl. No.: 581,513

[22] PCT Filed: Nov. 26, 1993

[86] PCT No.: PCT/EP93/03317

§ 371 Date: Mar. 27, 1996

§ 102(e) Date: Mar. 27, 1996

[87] PCT Pub. No.: WO95/02668

PCT Pub. Date: Jan. 26, 1995

[30] Foreign Application Priority Data

Jul. 12, 1993 [DE] Germany ..... 43 23 252.3

[51] Int. Cl.[6] ..... C11D 1/825; C11D 1/722; C11D 3/20

[52] U.S. Cl. ..... 510/514; 510/219; 510/422; 510/434; 510/477; 510/506; 510/535

[58] Field of Search ..... 510/219, 422, 510/421, 506, 514, 535, 434, 477; 252/243, 242

[56] References Cited

U.S. PATENT DOCUMENTS

| | | | |
|---|---|---|---|
| 3,549,543 | 12/1970 | Kirstahler et al. | 510/514 |
| 4,405,490 | 9/1983 | Maas et al. | 252/358 |
| 4,548,729 | 10/1985 | Schmid et al. | 510/219 |
| 4,780,237 | 10/1988 | Schmid et al. | 252/174.22 |
| 4,853,145 | 8/1989 | Schmid et al. | 510/421 |
| 4,942,049 | 7/1990 | Schmid et al. | 429/326 |
| 4,965,019 | 10/1990 | Schmid et al. | 510/406 |
| 4,973,423 | 11/1990 | Geke et al. | 510/421 |
| 5,205,959 | 4/1993 | Schmid et al. | 510/422 |
| 5,308,401 | 5/1994 | Geke et al. | 134/2 |

FOREIGN PATENT DOCUMENTS

| | | |
|---|---|---|
| 0197434 | 10/1986 | European Pat. Off. . |
| 0254208 | 1/1988 | European Pat. Off. . |
| 0343503 | 11/1989 | European Pat. Off. . |
| 0379256 | 7/1990 | European Pat. Off. . |
| 2343145 | 3/1975 | Germany . |
| 3928600 | 3/1991 | Germany . |
| 4243643 | 8/1993 | Germany . |

OTHER PUBLICATIONS

English translation of DE 39 28 600, published Mar. 7, 1991, Jul. 1997.

Tens. Surf. Det. 28, 313 (1991).

*Primary Examiner*—Ardith Hertzog

*Attorney, Agent, or Firm*—Ernest G. Szoke; Wayne C. Jaeschke; Real J. Grandmaison

[57] ABSTRACT

A rinse aid composition for hard surfaces containing a) mixed ethers corresponding to formula (I)

$$R^1O-(CH_2\overset{\overset{CH_3}{|}}{C}HO)_{m1}(CH_2CH_2O)_{n1}-OR^2 \quad (I)$$

in which $R^1$ is a linear or branched, aliphatic alkyl or alkenyl radical containing 8 to 18 carbon atoms, $R^2$ is a linear or branched alkyl radical containing 1 to 4 carbon atoms or a benzyl radical, m1 has a value of 0 or 1 to 2 and n1 has a value of 5 to 15, and b) fatty alcohol polypropylene glycol/polyethylene glycol ethers corresponding to formula (II)

$$R^3O-(CH_2\overset{\overset{CH_3}{|}}{C}HO)_{m2}(CH_2CH_2O)_{n2}-H \quad (II)$$

in which $R^3$ is a linear or branched, aliphatic alkyl or alkenyl radical containing 8 to 16 carbon atoms, m2 has a value of 0 or 1 to 3 and n2 has a value of 1 to 5.

6 Claims, No Drawings

MIXTURES OF NONIONIC ETHERS FOR USE AS RINSE AIDS AND/OR CLEANING HARD SURFACES

BACKGROUND OF THE INVENTION

1. Field of the Invention

This invention relates to new formulations for the machine cleaning of hard surfaces, more particularly rinse aids, containing mixed ethers and special fatty alcohol polyglycol ethers and to the use of these mixtures for the production of the new formulations.

2. Discussion of Related Art

Commercial rinse aids are mixtures of low-foaming fatty alcohol polyethylene/polypropylene glycol ethers, solubilizers (for example cumene sulfonate), organic acids (for example citric acid) and solvents (for example ethanol). The function of rinse aids is to influence the interfacial tension of the water in such a way that it is able to drain from the rinsed surfaces in the form of a thin coherent film, so that no water droplets, streaks or films are left after the subsequent drying process. A review of the composition of rinse aids and methods for testing their performance is presented by W. Schirmer et al. in Tens. Surf. Det. 28, 313 (1991).

In addition, where modern phosphate-free, low-alkali detergents are used for machine dishwashing, lime and silicate coatings can form on the rinsed surfaces and on the inside of the interior of the dishwashing machine because the calcium binding capacity of these detergents is lower than that of conventional phosphate-containing products. Troublesome lime or silicate coatings occur in particular when the rinsing water of the dishwashing machine has not been softened sufficiently, if at all, and exceeds a hardness of 4° d. In cases such as these, lime silicate coatings can be effectively avoided if citric acid is introduced into the final rinse cycle through the rinse aid. However, since the quantities of rinse aid normally added during the final rinse cycle are very small, i.e. 3 ml to 6 ml, the citric acid content of rinse aid formulations designed to guarantee effective inhibition of coatings has to be relatively high to achieve an adequate acid or complexing capacity. High citric acid contents support the effect of the phosphate substitutes and guarantee spotless crockery.

EP-B1 0 197 434 (Henkel) describes rinse aids which contain mixed ethers as surfactants. Various materials (glass, metal, silver, plastic, china) are washed in dishwashing machines. These various materials have to be thoroughly wetted in the final rinse. Rinse aid formulations containing mixed ethers as their only surfactant component meet these requirements to only a limited extent, if at all, so that the clear-rinse effect or drying effect is unsatisfactory, particularly in the case of plastic surfaces.

In addition, only ingredients which are completely biodegradable and toxicologically safe are now regarded as suitable for use in detergents, including rinse aid formulations. Solventless products are of particular interest in this regard.

Accordingly, the problem addressed by the present invention was to provide new ecologically and toxicologically safe formulations which would perform as well as conventional formulations and which would not have any of the disadvantages mentioned above.

DESCRIPTION OF THE INVENTION

The present invention relates to formulations for cleaning hard surfaces containing a) mixed ethers corresponding to formula (I):

$$R^1O-(CH_2\overset{\overset{CH_3}{|}}{C}HO)_{m1}(CH_2CH_2O)_{n1}-OR^2 \quad (I)$$

in which $R^1$ is a linear or branched, aliphatic alkyl and/or alkenyl radical containing 8 to 18 carbon atoms, $R^2$ is a linear or branched alkyl radical containing 1 to 4 carbon atoms or a benzyl radical, m1 has a value of 0 or 1 to 2 and n1 has a value of 5 to 15, and b) fatty alcohol polypropylene glycol/polyethylene glycol ethers corresponding to formula (II):

$$R^3O-(CH_2\overset{\overset{CH_3}{|}}{C}HO)_{m2}(CH_2CH_2O)_{n2}-H \quad (II)$$

in which $R^3$ is a linear or branched, aliphatic alkyl and/or alkenyl radical containing 8 to 16 carbon atoms, m2 has a value of 0 or 1 to 3 and n2 has a value of 1 to 5.

It has surprisingly been found that cleaning formulations, more particularly rinse aids, containing mixed ethers and fatty alcohol polypropylene/polyethylene glycol ethers not only show high ether toxicological compatibility, they also meet the requirements which a commercial product is expected to satisfy in relation to its performance properties.

Another advantage, which is of particular relevance for rinse aids, is that the preparation of homogeneous, low-viscosity and hence readily dispensable solutions does not require the use of any other, generally inert solubilizers which make no contribution to drying or the clear-rinse effect, such as for example sodium cumene sulfonate, ethanol or glucose sirup, except in cases where they are needed in small quantities for the incorporation of dyes and/or fragrances.

Mixed ethers

Mixed ethers are known end-capped fatty alcohol polyglycol ethers which may be obtained by relevant methods of preparative organic chemistry. Fatty alcohol polyglycol ethers are preferably reacted with alkyl halides, more particularly butyl or benzyl chloride, in the presence of bases. Typical examples are mixed ethers corresponding to formula (I), in which $R^1$ is a technical $C_{12/18}$ or $C_{12/14}$ cocoalkyl radical, m1 has a value of 0, n1 has a value of 5 to 10 and $R^2$ is a butyl group (Dehypon® LS-54, LS-104, LT-54, LS-104, Henkel KGaA, Düsseldorf, FRG). The use of mixed ethers terminated by butyl or benzyl groups is particularly preferred for applicational reasons.

Fatty alcohol polypropylene/polyethylene glycol ethers

The polyglycol ethers which form component b) are known nonionic surfactants which are obtained by addition of propylene oxide and then ethylene oxide or ethylene oxide alone onto fatty alcohols. Typical examples are polyglycol ethers corresponding to formula (II) in which $R^3$ is an alkyl radical containing 12 to 18 carbon atoms, m2 has a value of 0 or 1 and n2 has a value of 2 to 5 (Dehydol® LS-2, LS-4, LS-5, Henkel KGaA, Düsseldorf, FRG). The polyglycol ethers may advantageously have a narrow homolog distribution. In cases such as these, formulations showing particularly favorable physical properties are obtained.

The formulations according to the invention may contain components a) and b) in a ratio by weight of 10:90 to 80:20, preferably in a ratio by weight of 30:70 to 70:30 and, more preferably, in a ratio by weight of 30:70 to 40:60.

Surfactants, auxiliaries and additives

The formulations according to the invention may contain as further surfactants nonionic substances of the alkyl oligoglucoside and/or fatty acid-N-alkyl glucamide type. The most important additives are monobasic and polybasic carboxylic acids, preferably hydroxycarboxylic acids. Typical examples are malic acid (monohydroxysuccinic acid), tartaric acid (dihydroxysuccinic acid); saturated aliphatic dicarboxylic acids, such as oxalic acid, malonic acid, succinic acid, glutaric acid, adipic acid; gluconic acid (hexane pentahydroxy-l-carboxylic acid), but preferably water-free citric acid. They may be used in quantities of around 1 to 50% by weight and are preferably used in quantities of around 1 to 30% by weight. Other suitable additives are, above all, dyes and fragrances.

Rinse aid formulations

Typical formulations according to the invention where they are intended to act as rinse aids may have the following composition for example (ad 100% by weight water):

0.5 to 20% by weight mixed ethers, 0.5 to 20% by weight fatty alcohol polypropylene glycol/polyethylene glycol ethers and 1 to 50% by weight carboxylic acids.

Formulations containing 3 to 10% by weight mixed ethers 3 to 10% by weight fatty alcohol polyethylene glycol ethers and 1 to 30% by weight citric acid are particularly advantageous.

Commercial applications

The formulations according to the invention contain ecotoxicologically safe ingredients, can be formulated without solvents and show excellent wetting power on various materials.

Accordingly, the present invention relates to the use of mixtures of mixed ethers and fatty alcohol polypropylene glycol/polyethylene glycol ethers for the production of formulations for cleaning hard surfaces, more particularly crockery, in which they may be present in quantities of 0.5 to 20% by weight and preferably 1 to 10% by weight, based on the formulation. Typical examples of such formulations are, above all, rinse aids, multipurpose cleaners, sanitary cleaners, bottle washing detergents and generally formulations in which low-foaming surfactants are normally used.

The following Examples are intended to illustrate the invention without limiting it in any way.

EXAMPLES

I. Surfactants used

A1) $C_{12/14}$ cocofatty alcohol-5 EO-butyl ether Dehypon® LS-54

A2) $C_{12/14}$ cocofatty alcohol-10 EO-butyl ether Dehypon® LS-104

A3) $C_{12/18}$ cocofatty alcohol-10 EO-butyl ether

B1) $C_{12/14}$ cocofatty alcohol 2 EO adduct Dehydol® LS-2

B2) $C_{12/14}$ cocofatty alcohol 4 EO adduct Dehydol® LS-4

B3) $C_{12/14}$ cocofatty alcohol 5 EO adduct Dehydol® LS-5

B4) $C_{12/14}$ cocofatty alcohol 2 PO adduct

B5) 2-Ethylhexyl alcohol 2 EO adduct

B6) $C_{12/14}$ cocofatty alcohol 3 EO adduct (NRE*)

C1) $C_{12/14}$ cocofatty alcohol 5 EO-4 PO adduct Dehydol® LS-54

C2) $C_{12/14}$ cocofatty alcohol 4 EO-5 PO adduct Dehydol® LS-45

*) NRE=Narrow range ethoxylate (narrow homolog distribution)

All the surfactants are commercial products of Henkel KGaA, Düsseldorf, FRG. Components A and B correspond to the invention while components C were used for comparison purposes.

II. Performance testing of the rinse aids

The composition of the surfactant component of the tested rinse aid formulations is shown in Table 1. Mixtures M1 to M6 correspond to the invention while mixtures M7 to M10 are intended for comparison.

TABLE 1

Rinse aid surfactant composition
Percentages as % by weight

| M | A1 % | A2 % | A3 % | B1 % | B2 % | B3 % | B4 % | B5 % | B6 % |
|---|---|---|---|---|---|---|---|---|---|
| M1 | | 30 | | | 70 | | | | |
| M2 | | 50 | | 20 | 30 | | | | |
| M3 | | 50 | | | | 30 | 20 | | |
| M4 | 30 | | | 40 | | 40 | | | |
| M5 | | 50 | | 40 | | | | 10 | |
| M6 | | | 35 | | | | | | 65 |

| M | A1 % | A2 % | B1 % | B2 % | B3 % | B4 % | B5 % | C1 % | C2 % |
|---|---|---|---|---|---|---|---|---|---|
| M7 | | | | | | | | 100 | |
| M8 | | | | | | | | | 100 |
| M9 | | 100 | | | | | | | |
| M10 | | 30 | | | | | | 70 | |

Legend: M = Mixture a) Foaming behavior of the surfactant mixtures

To determine the foaming behavior of the surfactant mixtures, two eggs (around 100 to 110 g) were diluted with water (16° d) in a ratio of 1:1 and stirred for 2 minutes in an electrical mixer. 100 g of the resulting emulsion were then made up to 500 ml with water (16° d) in a double-walled 2000 ml measuring cylinder and heated to 50° C. After the test temperature had been reached, 20 g of surfactant mixtures M1 to M9 were added to the mixture. By means of a laboratory flow inducer, the solution was taken in from the bottom of the measuring cylinder through a glass tube. It was returned through a second tube of which the lower end terminated at the 2000 ml mark of the measuring cylinder. The liquid was pump-circulated at a rate of 4 l/minute. The volume of the foam formed and the liquid was read off after 5, 10, 20 and 30 minutes. The results are set out in Table 2:

TABLE 2

Foaming behavior of the surfactant mixtures

| Mixture | Volume in ml after mins. 5 | 10 | 20 | 30 |
|---|---|---|---|---|
| M1 | 750 | 850 | 1030 | 1060 |
| M2 | 720 | 825 | 1000 | 1020 |
| M3 | 710 | 800 | 980 | 1020 |
| M4 | 720 | 810 | 900 | 990 |
| M5 | 600 | 750 | 1020 | 1040 |
| M6 | 700 | 840 | 900 | 1000 |
| M7 | 760 | 900 | 1100 | 1120 |
| M8 | 600 | 700 | 1040 | 1060 |
| M9 | 600 | 700 | 900 | 1000 |
| M10 | 750 | 920 | 1100 | 1120 |

b) Foaming behavior of the rinse aid formulations

The foam generation of the rinse aid was determined by means of a circulation pressure gauge. The rinse aid (3 ml) was introduced by hand during the final rinse cycle at 50° C. Foaming was evaluated on the following scale:

0 points=no foaming 1 point=slight foaming 2 points=medium foaming (still acceptable)

3 points=vigorous foaming c) Drying:

15 Minutes after the end of the wash program, the door of the dishwashing machine was fully opened. After 5 minutes, drying was determined by counting the number of droplets remaining on the items of crockery listed below. Evaluation:

0 points=more than 5 droplets 1 point=5 droplets 2 points=4 droplets 3 points=3 droplets 4 points=2 droplets 5 points=1 droplet 6 points=no droplets (optimal drying)

d) Clear rinse effect:

After drying had been evaluated, the items of crockery were removed from dishwashing machine, left to cool for 30 minutes and then visually evaluated under light in a black box. The dried residual droplets, streaks, coatings, opaque films etc. left on the crockery and cutlery were evaluated. Evaluation:

0 points=poor clear rinse effect 8 points=optimal clear rinse effect e) Performance tests c) and d) were carried out with softened water in a Bauknecht GSF 1162 dishwashing machine. The 65° C. normal program was selected for this purpose. 40 ml of Somat® detergent (Henkel) were added during the wash cycle. The quantity of rinse aid was 3 ml and was added by hand at 50° C. during the final rinse cycle. The water had a salt content of 600 to 700 mg/l. Three wash cycles were carried out for each rinse aid formulation. The following items of crockery were used for evaluating drying and the clear-rinse effect:

6 "Neckar-Becher" glasses (Schott-Zwiesel),

3 "Brasilia" stainless steel knives (WMF), 3 white china dinner plates (Arzberg), 3 red "Valon" plastic dinner plates (Hass mann).

Examples 1 to 5, Comparison Examples C1 to C4

TABLE 3

Rinse aids, test results
Percentages as % by weight ad 100% by weight water

| Ex. | M | c (Surfactant) % | CA % | FR % | St. °C. | App. | F |
|---|---|---|---|---|---|---|---|
| 1 | M1 | 17.5 | 3.0 | 0.5 | >70 | Clear | 0 |
| 2 | M2 | 17.5 | 3.0 | 0.5 | >70 | Clear | 0 |
| 3 | M3 | 17.5 | 3.0 | 0.5 | >70 | Clear | 0 |
| 4 | M4 | 17.5 | 3.0 | 0.5 | >70 | Clear | 0 |
| 5 | M5 | 17.5 | 3.0 | 0.5 | >70 | Clear | 0 |
| C1 | M6 | 17.5 | 3.0 | 0.5 | >75 | Clear | 1 |
| C2 | M7 | 17.5 | 3.0 | 0.5 | >75 | Clear | 1 |
| C3 | M8 | 17.5 | 3.0 | 0.5 | >75 | Clear | 1 |
| C4 | M9 | 17.5 | 3.0 | 0.5 | >75 | Clear | 1 |

Examples 6 to 10, Comparison Examples C5 to C9

TABLE 4

| | | Drying of the items of crockery/clear rinse effect | | | | | | | |
|---|---|---|---|---|---|---|---|---|---|
| | | Glasses | | Knives | | China | | Plastic | |
| Ex. | M. | D | CRE | D | CRE | D | CRE | D | CRE |
| 6 | M1 | 3.7 | 6.2 | 4.1 | 3.0 | 5.0 | 6.3 | 4.0 | 5.3 |
| 7 | M2 | 3.5 | 6.1 | 4.2 | 2.9 | 5.1 | 6.3 | 3.9 | 5.5 |
| 8 | M3 | 3.6 | 6.2 | 4.3 | 3.1 | 4.8 | 6.4 | 4.1 | 5.3 |
| 9 | M4 | 3.4 | 6.1 | 4.4 | 3.2 | 4.9 | 6.4 | 4.1 | 5.1 |
| 10 | M5 | 3.3 | 6.0 | 4.5 | 3.1 | 4.8 | 6.3 | 4.0 | 5.3 |
| C5 | * | 4.8 | 6.0 | 4.8 | 6.6 | 5.0 | 8.0 | 5.0 | 6.8 |
| C6 | M6 | 2.7 | 5.7 | 4.1 | 2.0 | 4.9 | 6.0 | 4.0 | 5.3 |
| C7 | M7 | 2.5 | 5.8 | 4.2 | 1.9 | 4.0 | 6.0 | 4.0 | 5.1 |
| C8 | M8 | 1.3 | 5.3 | 2.3 | 1.7 | 4.0 | 4.3 | 2.7 | 4.5 |
| C9 | M9 | 2.4 | 5.8 | 4.4 | 2.2 | 4.9 | 6.4 | 4.1 | 5.1 |

Legend:
D = Drying
CRE = Clear rinse effect
* = Commercial rinse aid

We claim:

1. The process of rinsing a hard surface comprising contacting said hard surface with a rinse aid composition consisting essentially of a) mixed ethers corresponding to formula (I)

$$R^1O-(CH_2\overset{\overset{CH_3}{|}}{C}HO)_{m1}(CH_2CH_2O)_{n1}-OR^2 \quad (I)$$

in which $R^1$ is a linear or branched, aliphatic alkyl or alkenyl radical containing 8 to 18 carbon atoms, $R^2$ is a linear or branched alkyl radical containing 1 to 4 carbon atoms or a benzyl radical, m1 has a value of 1 to 2 and n1 has a value of 5 to 15, and b) fatty alcohol polypropylene glycol/polyethylene glycol ethers corresponding to formula (II)

$$R^3O-(CH_2\overset{\overset{CH_3}{|}}{C}HO)_{m2}(CH_2CH_2O)_{n2}-H \quad (II)$$

in which $R^3$ is a linear or branched, aliphatic alkyl or alkenyl radical containing 8 to 16 carbon atoms, m2 has a value of 1 to 3 and n2 has a value of 1 to 5, wherein component a) and component b) are present in a weight ratio of 10:90 to 80:20.

2. A process as in claim 1 wherein said composition consists essentially of 0.5 to 20% by weight of said component a), 0.5 to 20% by weight of said component b), 1 to 50% by weight of a carboxylic acid, and the balance to 100% of water, all weights being based on the weight of said composition.

3. A process as in claim 1 wherein $R^2$ is a butyl or benzyl group.

4. The process of cleaning a hard surface comprising contacting said surface with a composition consisting essentially of a) mixed ethers corresponding to formula (I)

$$R^1O-(CH_2\overset{\overset{CH_3}{|}}{C}HO)_{m1}(CH_2CH_2O)_{n1}-OR^2 \quad (I)$$

in which $R^1$ is a linear or branched, aliphatic alkyl or alkenyl radical containing 8 to 18 carbon atoms, $R^2$ is a linear or branched alkyl radical containing 1 to 4 carbon atoms or a benzyl radical, m1 has a value of 1 to 2 and n1 has a value of 5 to 15, and b) fatty alcohol polypropylene glycol/polyethylene glycol ethers corresponding to formula (II)

$$R^3O-(CH_2\overset{\overset{\displaystyle CH_3}{|}}{C}HO)_{m2}(CH_2CH_2O)_{n2}-H \qquad \text{(II)}$$

in which $R^3$ is a linear or branched, aliphatic alkyl or alkenyl radical containing 8 to 16 carbon atoms, m2 has a value of 1 to 3 and n2 has a value of 1 to 5, wherein component a) and component b) are present in a weight ratio of 10:90 to 80:20.

5. A process as in claim 4 wherein said composition consists essentially of 0.5 to 20% by weight of said component a), 0.5 to 20% by weight of said component b), 1 to 50% by weight of a carboxylic acid, and the balance to 100% of water, all weights being based on the weight of said composition.

6. A process as in claim 4 wherein $R^2$ is a butyl or benzyl group.

* * * * *